US006378492B1

(12) United States Patent
Liu

(10) Patent No.: US 6,378,492 B1
(45) Date of Patent: Apr. 30, 2002

(54) IDLE CONTROL FOR INTERNAL COMBUSTION ENGINE

(75) Inventor: Ching-Po Liu, Grand Blanc, MI (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/666,621

(22) Filed: Sep. 21, 2000

Related U.S. Application Data

(60) Provisional application No. 60/157,177, filed on Sep. 30, 1999.

(51) Int. Cl.[7] ..... F02D 41/16

(52) U.S. Cl. ..... 123/339.18; 123/339.19

(58) Field of Search ..... 123/339.16–339.19, 123/339.23, 352–355; 290/40 A; 322/25, 27, 28

(56) References Cited

U.S. PATENT DOCUMENTS 5,256,959 A 10/1993 Nagano et al.
5,467,008 A 11/1995 Uchinami
6,109,237 A * 8/2000 Pels et al. ..... 123/339.19

FOREIGN PATENT DOCUMENTS

| | | |
|---|---|---|
| GB | 2157028 | 4/1995 |
| JP | 59039945 | 3/1984 |
| JP | 63314346 | 12/1988 |

* cited by examiner

*Primary Examiner*—Tony M. Argenbright

(57) ABSTRACT

An internal combustion engine is provided having a crankshaft which rotates in an actual crankshaft speed. An accessory drive is driven by the crankshaft and includes an accessory drive component, such as an alternator, which produces a load on the crankshaft. A speed sensor senses an engine speed associated with the actual crankshaft speed and produces a speed signal. A controller sends a control signal to the accessory drive component in response to the speed signal to change the load of the accessory drive component and maintain the actual crankshaft speed at a target crankshaft speed. If sufficient control of the engine speed is not possible by changing the load of the accessory drive component alone, the throttle may also be changed to overcome the load fluctuations of the engine and assist the control provided by the accessory drive component.

17 Claims, 2 Drawing Sheets

IDLE CONTROL FOR INTERNAL COMBUSTION ENGINE

RELATED APPLICATIONS

This application claims priority to provisional application No. 60/157,177 filed on Sep. 30, 1999.

BACKGROUND OF THE INVENTION

This invention relates to internal combustion engines, and more particularly, the invention relates to an idle control for an internal combustion engine.

Internal combustion engines have a torque for a particular RPM that varies based upon several parameters. For spark ignition internal combustion engines, the torque varies based upon ignition of the air/fuel mixture relative to crankshaft rotation or piston position within the combustion chamber. An engine produces a maximum amount of torque at approximately 35° before the piston reaches top dead center of the combustion chamber for a particular RPM. Operating an engine at maximum torque for a particular RPM is desirable so that the most amount of torque is available at any given moment.

It is desirable to idle an engine at the lowest RPM at which the engine is able to ran stable for increased fuel efficiency. However, at lower RPMs the speed of the engine may fluctuate causing the engine to run "rough" due to load fluctuations. For example, as an air conditioning compressor cycles on and off while the engine is idling the speed may fluctuate causing the engine to idle rough due to the load fluctuations from the compressor. As a result, the spark is typically retarded to approximately 10°–15° before top dead center so that torque is available to overcome these load fluctuations. The engine controller varies the spark to vary the engine torque and overcome the load fluctuations. Overcoming load fluctuations by increasing or decreasing the air flow through the throttle above is not practical since there is an undesirable amount of time between the throttle actuation and the response of the engine. Spark control of the engine provides a response time that is approximately ten times greater than that of throttle control.

Unfortunately, the maximum torque for that particular RPM is no longer available since the spark is retarded. As the load on the engine increases at idle, such as when the compressor turns on, the spark is advanced so that the engine torque increases thereby overcoming the increased load caused by the compressor. In this manner, engine idling stability is increased so that engine smoothness is improved. Therefore, what is needed is an engine idle control that enables the engine to be run at the maximum torque for the particular engine RPM so that the greatest amount of torque is available at any given moment.

SUMMARY OF THE INVENTION AND ADVANTAGES

The present invention provides an internal combustion engine having a crankshaft which rotates at an actual crankshaft speed. An accessory drive is driven by the crankshaft and includes an accessory drive component, such as an alternator, which produces a load on the crankshaft. A speed sensor senses an engine speed associated with the actual crankshaft speed and produces a speed signal. A controller sends a control signal to the accessory drive component in response to the speed signal to change the load of the accessory drive component and maintain the actual crankshaft speed at a target crankshaft speed. If the actual speed is greater than the target speed, the duty cycle of the accessory drive component may be increased to put a greater load on the engine and lower the actual speed toward the target speed. Conversely, if the actual speed is lower than the target speed, the duty cycle of the accessory drive component may be decreased to decrease the load on the engine and increase the actual speed toward the target speed. As a result, spark control of the engine is not required to overcome load fluctuations so that the engine may be run at the maximum torque for the particular engine speed. If sufficient control of the engine speed is not possible by changing the load of the accessory drive component alone, the throttle may also be changed to overcome the load fluctuations of the engine and assist the control provided by the accessory drive component.

Accordingly, the present invention provides an engine idle control that enables the engine to be run at the maximum torque for the particular engine RPM so that the greatest amount of torque is available at any given moment.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
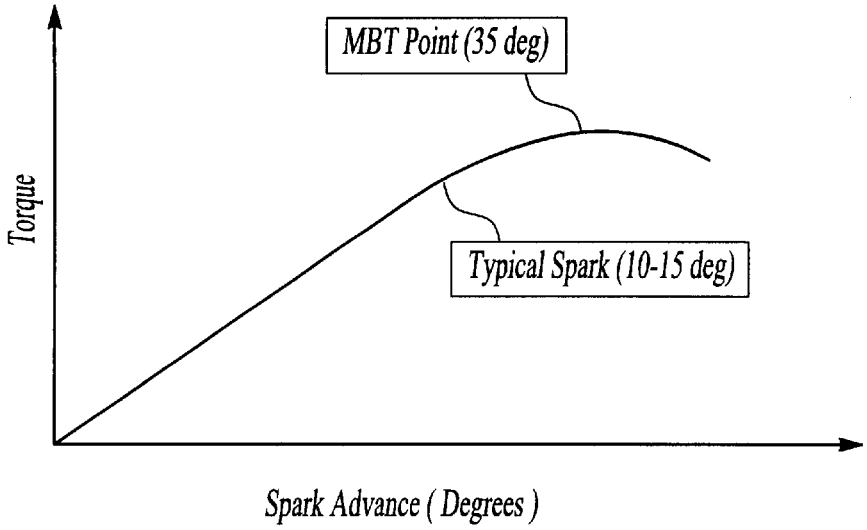
FIG. 1 is a graphically representation of torque versus spark advance for a particular RPM.

FIG. 1 depicts the torque versus spark advance for a particular RPM. Farther right along the torque curve indicates a greater spark advance before top dead center. A typical spark advance is 10°–15° before top dead center. That is, the ignition coil generates a spark at the spark plug to ignite the air/fuel mixture in the combustion chamber 10°–15° before the piston reaches the very top of the combustion chamber. After the air fuel mixture is ignited, the flame propagates across the combustion chamber so that the maximum force is generated on the piston at a point after top dead center. In this manner, the crankshaft is rotated and a torque at the crankshaft is achieved. As mentioned above, a spark advance of 35° before top dead center generates a force on the piston that is greater than the force generated by a spark advance of 10°–15°. As a result, a spark advance of 350 before top dead center is more desirable than a spark advance of 10°–15° before top dead center.

Figure 2:
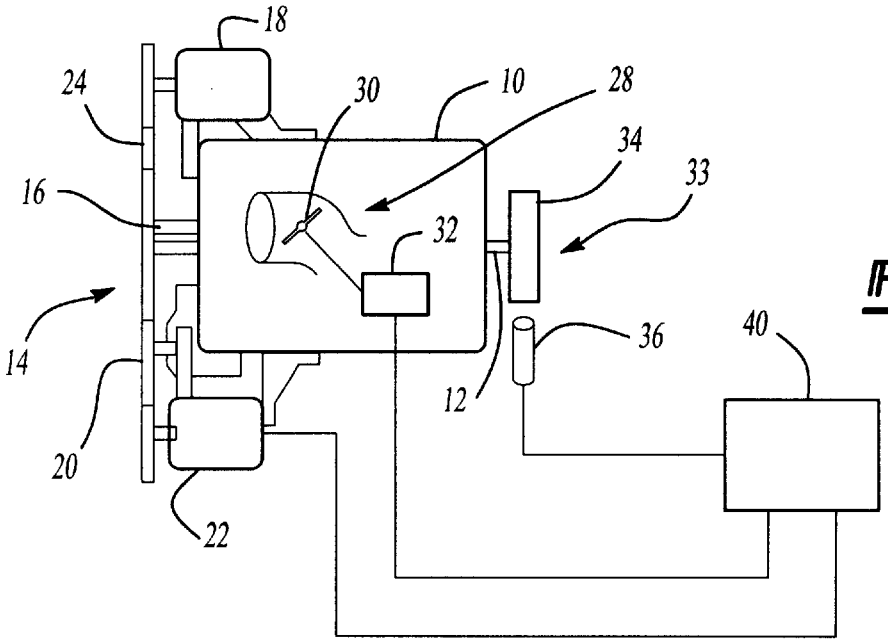
FIG. 2 is a schematic view of an internal combustion engine and the idle control of the present invention.
Figure 3:
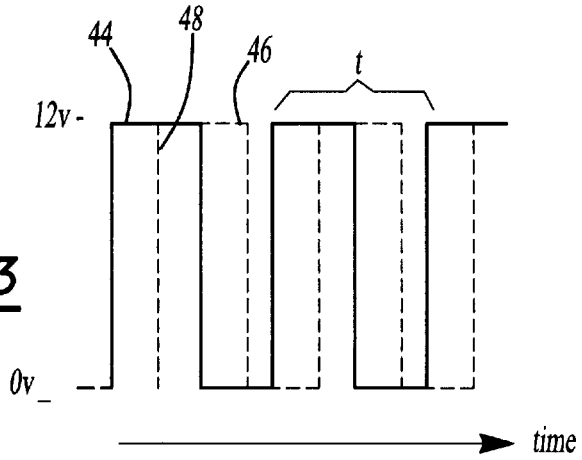
FIG. 3 is a graphical representation of duty cycles for an accessory drive component with the present invention.

An engine 10 having a crankshaft 12 is shown in FIG. 2. Combustion of the air fuel mixture in the combustion chamber causes the crankshaft 12 to rotate about its axis. The crankshaft 12 not only generates torque to propel the vehicle, but also drives an accessory drive system 14. The accessory drive includes a water pump 16, and A/C compressor 18, a steering pump 20, an alternator 22, and other accessory drive components. The accessory drive components are driven by a drive belt 24 that is connected to a crankshaft pulley (not shown). The accessory drive components control various aspects of engine and vehicle operation and put a load on the engine 10.

The engine 10 includes an air induction system 28 that provides atmospheric air to the engine 10 to carry an air/fuel mixture to each of the combustion chambers. The amount of air that enters the combustion chamber is controlled by a throttle 30 that includes a throttle blade that opens and closes the air induction system 28 to varying degrees. The throttle 30 is typically actuated by a cable that is connected to the accelerator pedal of the vehicle. The throttle 30 may also be actuated by a throttle actuator 32 that is controlled electronically or otherwise. The throttle actuator 32 may be connected to a cruise control system and various other devices.

The engine 10 typically includes a speed sensor 33, which typically includes a timing wheel 34 having various timing notches and a proximity sensor 36 adjacent to the timing wheel to sense the passing of the timing notches. The timing wheel 34 may be connected directly to the crankshaft 12 or to a cranshaft The speed sensor 33 is used to detect the RPM of the crankshaft 12 so that the engine 10 may be controlled in a more desirable manner. It is to be understood that any speed sensor may be used with the present invention.

Accessory drive components, such as the alternator 22, and the throttle actuator 32 and the speed sensor 33 are typically connected to an ECU 40. The ECU monitors engine 10 and accessory drive system 14 operation to control the engine 10 and the accessory drive system 14 in a desired manner. For example, the ECU cycles the alternator 22 on and off to provide a desired charging voltage to provide power to the vehicle systems and maintain a charge on the vehicle's battery. A normal duty cycle 44 may include 60% on time and 40% off time for a cycle $\tau$ at 150 Hz. That is, the alternator 22 is cycled 150 times per second, and for each cycle the alternator 22 is on for approximately 60% of the time. Said another way, the alternator 22 puts a load on the engine 10 for 60% of the time each cycle. If the duty cycle is increased, shown at reference number 46, than a greater load is put on the engine 10. Conversely, if the duty cycle is decreased, shown at the reference number 48, then the engine 10 experiences a decreased load. Said another way, an increased duty cycle puts the engine 10 under a load for a longer period of time, while a decreased duty cycle puts the engine 10 under load for a shorter amount of time.

It is desirable to idle an engine at a low RPM for better fuel efficiency. For example, it may be desirable to idle a four cylinder engine at 700 RPM. The lower the RPM, the lower the torque and the more susceptible that the engine 10 is to load fluctuation and idle roughness. The prior art utilizes spark control to control engine idle and retards the spark so that torque is available to overcome load fluctuations during engine idle. The present invention utilizes accessory drive component control, preferably alternator control, to overcome load fluctuations and improve idle smoothness. Specifically, the duty cycle of the alternator 22 maybe controlled to increase or decrease the load on the engine 10 to increase or decrease the engine RPM. If the target idle RPM for the engine above is 700 RPM, and the engine RPM is reduced to 670 RPM due to an increase load on the engine, the engine RPM must be increased. This may be caused, for example, by the A/C compressor 18 being turned on. Conversely, once the engine speed is stabilized and a load is taken off the engine 10, for example, by turning the A/C compressor 18 the engine RPM will increase past the target RPM and the engine must then be slowed to maintain the idle speed.

Figure 4:
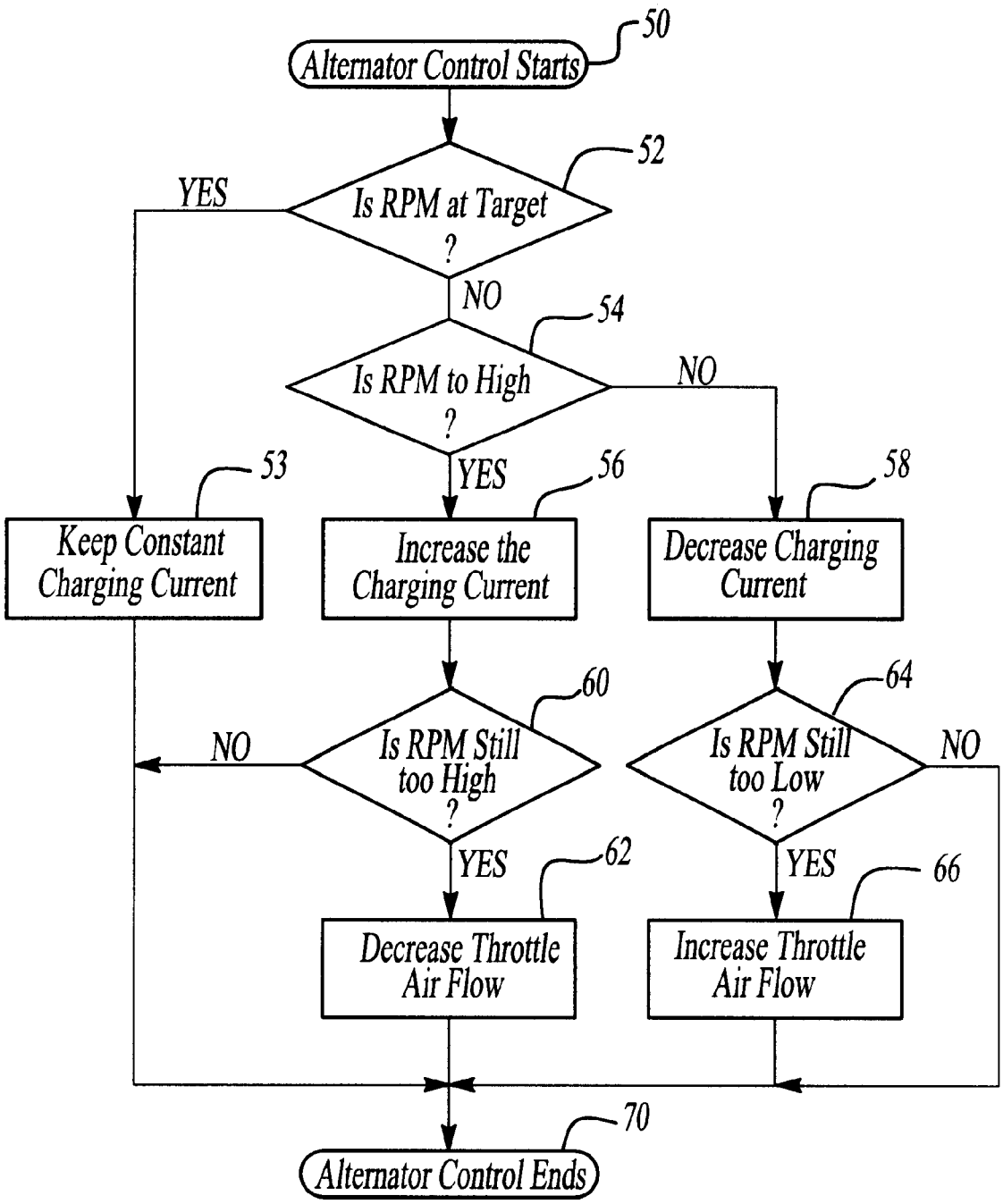
FIG. 4 is a flowchart for the present invention idle control.

The ECU 40 receives a speed signal from the speed sensor 33 to sense the actual engine or crankshaft speed. The ECU 40 compares the actual engine speed to a target engine speed and adjusts the engine speed toward the target speed if necessary. Referring to FIG. 4, the ECU 40 may include an engine control routine that begins at block 50. The speed sensor 33 detects the actual engine RPM. The ECU 40 determines whether the engine speed is at the target speed, represented by decisional block 52. If the engine speed is at the target speed then the ECU 40 will maintain the current duty cycle of the alternator 22 shown at 53, and end the engine idle routine at block 70. However, if the engine speed is too high, which is determined at decisional block 54, the duty cycle must be increased, which is shown at block 56. If the RPM is too low, the duty cycle of the alternator 22 must be decreased, shown at block 58. Controlling the duty cycle of the alternator 22 will provide adequate engine idle control most of the time. However, if control of the alternator 22 is not sufficient, the ECU 40 may also actuate the throttle 30 with the throttle actuator 32. If after increasing the duty cycle of the alternator 22 the engine speed is still too high, which is presented by decisional block 60, the throttle 30 may be closed to decrease the air flow to the combustion chamber, shown at block 62. In the case of an engine speed that is still too low after decreasing the duty cycle of the alternator 22, the throttle 30 may be opened by the throttle actuator 32 to increase the air flow to the combustion chamber, shown at block 66.

The present invention obviates the need for spark control, and as a result, the engine may be run at a maximum torque for a particular RPM. Using the alternator 22 for controlling the engine idle speed is illustrative, and other accessory drive components maybe used.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A method of controlling an engine speed comprising the steps of:

a) running an engine at an actual engine speed;

b) determining if the actual engine speed is at a target engine speed;

c) changing an accessory drive component load to maintain the actual engine speed at the target engine speed;

d) determining if changing the accessory drive component load achieved the target engine speed; and e) changing throttle air flow to maintain the actual engine speed at the target engine speed if changing the accessory drive component load was unable to achieve the target engine speed.

2. The method according to claim 1, wherein the accessory drive component is an alternator.

3. The method according to claim 1, wherein step c) includes increasing the accessory drive component load to decrease tile actual engine speed if the actual engine speed is greater than the target engine speed.

4. The method according to claim 1, wherein step c) includes decreasing the accessory drive component load to increase the actual engine speed if the actual engine speed is less than the target engine speed.

5. The method according to claim 3, wherein step e) includes decreasing the throttle air flow to further decrease the actual engine speed if the actual engine speed is greater than the target engine speed.

6. The method according to claim 4, wherein step e) includes increasing the throttle air flow to further increase the actual engine speed if the actual engine speed is less than the target engine speed.

7. The method according to claim 3, wherein step c) includes increasing a duty cycle of an accessory drive component.

8. The method according to claim 4, wherein step c) includes decreasing a duty cycle of an accessory drive component.

9. An internal combustion engine comprising:

a crankshaft rotating at a actual crankshaft speed;

an accessory drive driven by said crankshaft and including an accessory drive component producing a load on said crankshaft;

a speed sensor sensing an engine speed associated with said actual crankshaft speed and producing a speed signal;

an air induction system with a throttle regulating airflow there through; and a controller sending a control signal to said accessory drive component in response to said speed signal to change said load and maintain said actual crankshaft speed at a target crankshaft speed, said controller determining whether said target crankshaft speed has been achieved by said change in said load, and said controller sending a second control signal to said throttle to change said airflow if said change in said load was unable to achieve said target crankshaft speed.

10. The engine according to claim 9, wherein said accessory drive component is an alternator.

11. The engine according to claim 9, wherein said engine speed is said actual crankshaft speed.

12. The engine according to claim 9, wherein said controller increases said accessory drive component load with said control signal in response to said speed sensor sensing said actual crankshaft speed greater than said target crankshaft speed.

13. The engine according to claim 9, wherein said controller decreases said accessory drive component load with said control signal in response to said speed sensor sensing said actual crankshaft speed less than said target crankshaft speed.

14. The engine according to claim 12, wherein said controller moves said throttle toward a closed position in response to said second control signal.

15. The engine according to claim 13, wherein said controller moves said throttle toward an open position in response to said second control signal.

16. The engine according to claim 12, wherein said control signal includes an increased duty cycle.

17. The engine according to claim 13, wherein said control signal includes a decreased duty cycle.

* * * * *